United States Patent [19]

Sunada

[11] Patent Number: 4,612,839

[45] Date of Patent: Sep. 23, 1986

[54] WAVEFORM DATA GENERATING SYSTEM

[75] Inventor: Takuya Sunada, Tokyo, Japan

[73] Assignee: Casio Computer Co., Ltd., Tokyo, Japan

[21] Appl. No.: 820,816

[22] Filed: Jan. 17, 1986

Related U.S. Application Data

[63] Continuation of Ser. No. 578,834, Feb. 10, 1984, abandoned.

[30] Foreign Application Priority Data

Feb. 21, 1983 [JP] Japan ..... 58-26328

[51] Int. Cl.[4] ..... G10H 1/08; G10H 7/00

[52] U.S. Cl. ..... 84/1.01; 84/1.22; 84/1.23

[58] Field of Search ..... 84/1.01, 1.19–1.23

[56] References Cited

U.S. PATENT DOCUMENTS

| | | | |
|---|---|---|---|
| Re. 30,834 | 12/1981 | Niimi et al. | 84/1.01 |
| 3,740,450 | 6/1973 | Deutsch | 84/1.23 X |
| 4,183,275 | 1/1980 | Niimi et al. . | |
| 4,213,366 | 7/1980 | Niimi et al. | 84/1.01 |
| 4,437,379 | 3/1984 | Okumura | 84/1.22 |

FOREIGN PATENT DOCUMENTS

| | | |
|---|---|---|
| 2237594 | 2/1973 | Fed. Rep. of Germany . |
| 3146292A | 7/1982 | Fed. Rep. of Germany . |
| 1245678 | 9/1971 | United Kingdom . |
| 1395376 | 5/1975 | United Kingdom . |
| 1409763 | 10/1975 | United Kingdom . |
| 1543958 | 4/1979 | United Kingdom . |
| 1572525 | 7/1980 | United Kingdom . |

*Primary Examiner*—S. J. Witkowski

*Attorney, Agent, or Firm*—Frishauf, Holtz, Goodman & Woodward

[57] ABSTRACT

In response to the data input from a keyboard, a tone clock generator generates a tone clock signal. The tone clock signal is counted by a waveform step counter. The output of the counter is used for making an access to a waveform memory. The waveform memory stores first and second waveform data of which the periods respectively are divided into a different number of addresses. One of the first and second waveform data read out from the waveform memory by the output of the counter is selected, according to the key-in data.

16 Claims, 15 Drawing Figures

WAVEFORM DATA GENERATING SYSTEM

This application is a continuation, of application Ser. No. 578,834, filed Feb. 10, 1984 and now abandoned.

BACKGROUND OF THE INVENTION

The present invention relates to a waveform data generating system using a waveform memory which stores the waveform data to determine a timbre of a musical tone.

In a known waveform data generating system, for performing a musical piece, waveform data is read out from a waveform memory assembled into an electronic musical instrument. A waveform of a musical tone with a pitch corresponding to a performance key operated is controlled by the read out waveform data. An example of such method is disclosed in U.S. Pat. No. 3,515,792. In this patent, an access speed to the waveform memory, which is sequentially performed from address 0 to the subsequent ones, is changeable according to a pitch of a musical tone. Therefore, the same timbre must be kept even if the pitch is changed. Nevertheless, a low-pitched tone and a high-pitched tone are equal to each other in the contents of the overtones, because the number of steps of reading out the waveform data from the waveform memory is fixed irrespective of pitches of a musical tone. Therefore, the timbre of a musical tone particularly in low-pitched tones is unsatisfactory. This problem may be solved with an additional provision of a plurality of external filters which are selectively used according to a range of the tone pitches. This approach, however, is accompanied by complicated construction and high cost to manufacture.

SUMMARY OF THE INVENTION

Accordingly, an object of the present invention is to provide a waveform data generating system with a simple construction and capable of generating tones with rich timbres even in a low-pitched tone range.

According to the present invention, there is provided a waveform data generating system having means for storing waveform data, means for inputting musical tone data, and means for reading out waveform data from the memory means according to the input musical tone data, wherein the memory means stores at least two waveform data of which the periods respectively are divided into different numbers of steps, and means for selectively obtaining amplitude data at given steps of the at least one of said two waveform data according to the input musical tone data, is provided for producing a mixed waveform data.

DETAILED DESCRIPTION OF THE PREFERRED EMBODIMENTS

Figure 1:
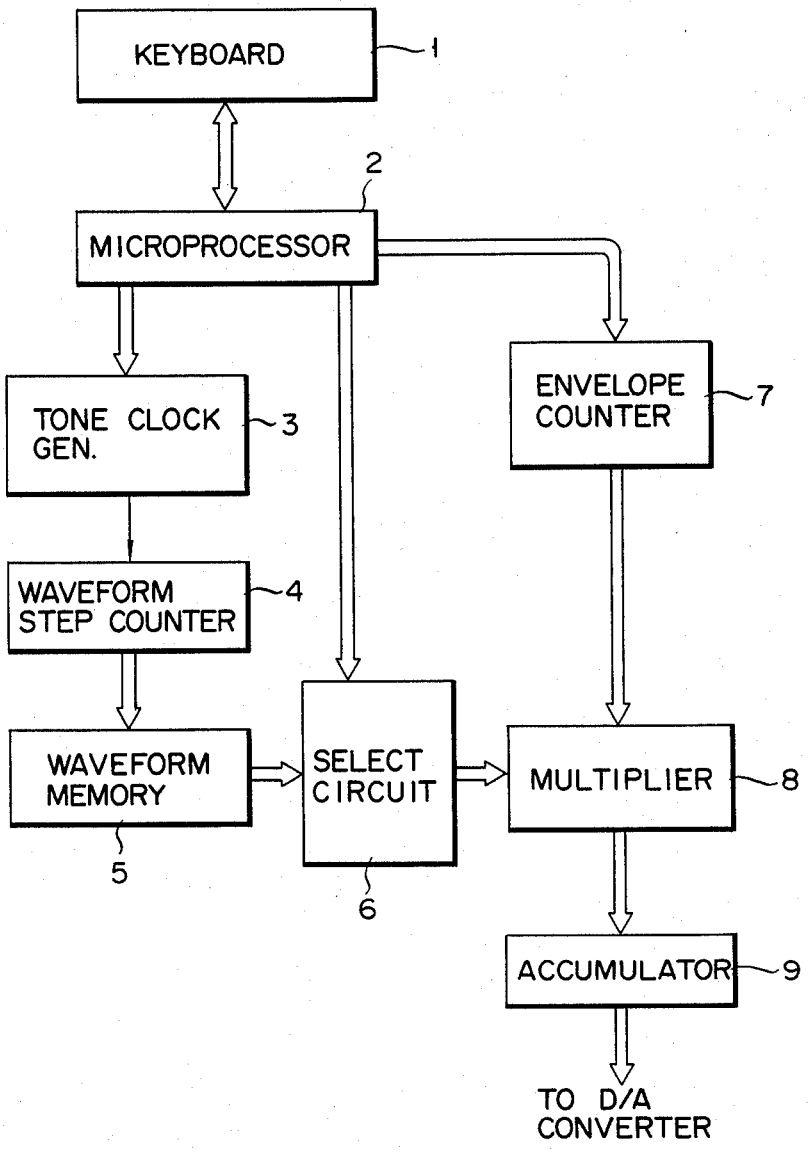
FIG. 1 is a block diagram of an embodiment of a waveform data generating system according to the present invention.

A general arrangement of a waveform data generating system, a first embodiment of the present invention, will be given referring to FIG. 1. FIG. 1 is an arrangement of a keyboard electronic musical instrument into which the present invention is incorporated. In FIG. 1, a keyboard 1 with a plurality of performance keys, for example, keys of four octaves, is periodically key-scanned by a control unit, for example, a microprocessor 2. The musical tone data as given by an operated key is input to the microprocessor 2. The microprocessor 2 supplies the input musical tone data to a tone clock generator 3. Then, the tone clock generator 3 produces a tone clock signal with a frequency dependent on a pitch as determined by an octave and a note of the operated key. The keyboard electronic musical instrument contains a 4-channel musical tone generating circuit of a 4-tone polyphonic type. This polyphonic type musical tone generating circuit, capable of generating a maximum of 4 tones, sequentially forms four musical tone data as inputted by four keys simultaneously operated, through a time divisional processing on the four channels, accumulates the formed data of four tones and audibly produces the four musical sounds simultaneously. The tone clock generator 3 is also divided into four channels. During each channel period, a tone clock signal with a frequency corresponding to each musical tone is generated.

The tone clock signal with a frequency corresponding to a pitch of the operated key, which is generated by the tone clock generator 3, is supplied to a waveform step counter 4. The waveform step counter 4 counts the tone clock signal to produce the count data as address data to the waveform memory 5.

Figure 3A:
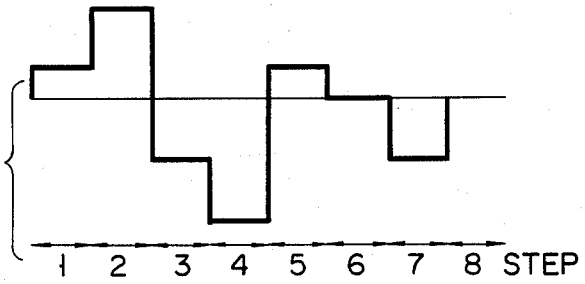
FIGS. 3A and 3B illustrate respectively 8-step and 16-step waveforms stored in a waveform memory in the waveform data generating system of FIG. 1.
Figure 3B:
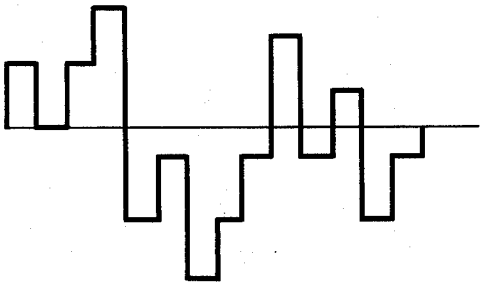

In this embodiment, the waveform memory 5 stores two types of musical tone waveform data, as shown in FIGS. 3A and 3B. Each musical tone waveform is basically divided into 8 steps. In a waveform of FIG. 3A, each step contains one amplitude data. In a waveform of FIG. 3B, each step contains two amplitude data. In the specification, the former is referred to as an 8-step waveform, and the latter as a 16-step waveform. The 8-step waveform and the 16-step waveform stored in the waveform memory 5 are read out by the same address data from the waveform step counter 4. Those amplitude data addressed are simultaneously read out and sent in parallel to a select circuit 6.

The select circuit 6 selects one of the two types of amplitude data coming from the waveform memory 5 dependent on the contents of the address data, and applies the selected one to one of the input terminals of a multiplier 8. The multipier 8 receives at the other input terminal an envelope signal from an envelope counter 7, and multiplies the envelope signal and the amplitude data for each channel.

The output of the multiplier 8 is supplied to an accumulator 9 where the four channel data are accumulated. The result of the accumulation is sent to a D/A converter within the fourth channel period, for example. The accumulated data as a tone signal of 4-channel polyphonic sound is converted into an analog signal which in turn drives a loudspeaker to audibly produce a polyphonic sound, i.e. four musical sounds maximum.

The waveform step counter 4, the waveform memory 5 and the select circuit 6 in the circuit arrangement of FIG. 1 will be described in more detail referring to FIG. 2. The tone clock signal generated by the tone clock generator 3 of FIG. 1 is supplied to a carry input terminal Cin of a half-adder 11. The half-adder 11 has input terminals A0–A3 respectively connected to the output terminals of AND gates 12-0 to 12-3. To input terminals of the AND gates 12-0 to 12-3 is supplied a reset signal through an inverter 13, while to the other input terminals thereof is supplied an output of a shift register 14. The half-adder 11 adds "1" to the input data at the input terminals A0 to A3 every time the clock signal is applied to the carry input terminal Cin of the half-adder 11. The results of the addition are output through the output terminals S0 to S3. The addition result data is transferred to input terminals of the shift register 14, and to the input terminals I0 to I3 of the waveform memory 5. The shift register 14 has an arrangement composed of four 4-bit registers coupled in a cascade fashion. The number of the registers corresponds to that of the polyphonic channels, i.e., four in this case. The reset signal supplied to the inverter 13 is for initializing the shift register 14, and becomes high in level when the power is on, for example. Upon receipt of a low signal from the inverter 13, all of the channels of the shift register 14 are cleared.

Of the four bits of the addition result data, the upper 3 bits are connected to the input terminals B0 to B2 of a full-adder 16 in the select circuit 6, by way of inverters 15-0 to 15-2. The other input terminals A0 to A2 of the full-adder 16 are coupled with the output terminals of a shift register 17. The shift register 17 has three-bit input terminals which are connected to receive step designating data from the microprocessor 2, via transfer gates 18-0 to 18-2. The step designating data is output from the shift register 17 and fed back to the input terminals thereof, through transfer gates 19-0 to 19-2. The shift registers 14 and 17 have the same constructions, respectively.

The gates of the transfer gates 18-0 to 18-2 and 19-0 to 19-2 are connected to receive, directly and via the inverter 20, key on pulses KEY ON output from the microprocessor 2 when the operation keys are ON.

The full-adder 16 adds the input data which comes in through the input terminals A0 to A2 and B0 to B2, and produces a carry through the carry output terminal Cout. The carry is transferred to the gates of transfer gates 21-0 to 21-3 directly, and via the inverter 23, to the gates of transfer gates 22-0 to 22-3. The transfer gates 21-0 to 21-3 are coupled with the 16-step amplitude data, while the transfer gates 22-0 to 22-3 are coupled with the 8-step amplitude data from the waveform memory 5. Either of the 16-step and 8-step waveform data is selected dependent on a logical state of the carry from the full-adder 16, and the selected one is transferred to the multiplier 8.

The operation of the overall waveform data generating system thus arranged will be described in brief referring to FIGS. 3A and 3B and 4A to 4H illustrating waveform diagrams.

When one performance key is operated, the key output produced is input from the keyboard 1 to the microprocessor 2. Upon receipt of the key output signal, the microprocessor 2 judges the key-on operation and its pitch, and appropriately assigns channels respectively to the musical tone generating channels. Further, the microprocessor 2 applies the frequency data of the pitch to the tone clock generator 3. Further, the microprocessor 2 applies the step designating data corresponding to the judged pitch to the select circuit 6, and applies the given envelope data to the envelope counter 7.

The tone clock generator 3 forms the clock signal using the input frequency data, and applies it to the waveform step counter 4 where the clock signal is counted. The waveform memory 5 is addressed by the output from the waveform step counter 4. From the waveform memory 5, the 8-step amplitude data and the 16-step amplitude data are read out in parallel and then are transferred to the select circuit 6. The select circuit 6 selects one of the two types of amplitude data on the basis of the contents of the step designating data, and supplies the selected one to the multiplier 8. When a performance key is rendered OFF during the sounding of the loudspeaker, the microprocessor 2 performs the key-off processing and releases the channel assignment, thereby stopping sounding of the musical sound.

Upon power on, the microprocessor 2 produces a reset signal in the form of a logical "1", and applies it to the waveform step counter 4 Therefore, the AND gates 12-0 to 12-3 are temporarily closed to allow the logical "0" signals to the input terminals A0 to A3 of the half-adder 11. Then, the output terminals S0 to S3 of the half-adder 11 provide the data of all "0's" which in turn is applied to the shift register 14. As a result, all of the four channels of the shift register 14 are cleared.

When the above one key is operated, the channel, e.g., a first channel assigned to the operated key and the clock signal generated by the tone clock generator 3 at the timing of the first channel is produced and applied to the carry input terminal Cin of the half-adder 11. At the timing of the first channel, the count data of the first channel cyclically coming from the shift register 14 through the AND gates 12-0 to 12-3 are applied to the input terminals A0 to A3 of the half-adder 11. Accordingly, immediately after the key on, the count data of 4 bits is all "0's". When the first clock signal is produced, the half-adder 11 performs the +1 operation to have the result data "0001" (corresponding to 1 in the decimal notation), which is then applied to the shift register 14, the waveform memory 5 and the select circuit 6. In the waveform step counter 4, the result data "0001" is held in the circulating circuit composed of the half-adder 11—the shift register 14—the AND gates 12-0 to 12-3—the half-adder 11, until the second clock signal for the first channel is produced. The half-adder 11 performs the +1 operation every time the second, third, . . . clock signals are produced in the first channel. As a result, the counted data is incremented one by one, "0010", "0011", . . . When the count data reaches "1111" (15 in the decimal notation), the waveform step counter 4 is cleared to be in the initial state. Subsequently, a similar operation is repeated.

In the waveform memory 5, in response to the count data "0000", "0001", "0010", . . . , the 8-step waveform data and the 16-step waveform data are read out in parallel with the designation of the same address.

Responding to the step designating data from the microprocessor 2, the select circuit 6 operates to select either of the 8-step amplitude data and the 16-step data, through the following operation. The microprocessor 2 produces the following data as the step designating data according to the pitch of the input tone data. As stated earlier, the performing keys in the keyboard 1 includes four octaves. If the notes are expressed by C1 to B4, the keys of each octave are classified into a low-pitch key group of the first six keys and a high-pitch key group of the second six keys. Under this condition, the step designating data is set at "111", "110", "101", "100", "011", "010", "001" and "000" respectively for the notes C1 to F1, F1# to B1, C2 to F2, F2# to B2, C3 to F3, F3# to B3, C4 to F4, and F4# to B4. As seen from those binary data, the smaller the value of the step designating data, the higher the pitch.

If the pitch of the operated key corresponds to any one of those pitches F4# to B4, the step designating data "000" is produced upon the key on operation, and it is transferred to the transfer gates 18-0 to 18-2. At the time of key on, a key on pulse KEY ON of "1" is produced at the assigned channel timing, to temporarily enable the transfer gates 18-0 to 18-2 and to temporarily disable the transfer gates 19-0 to 19-2. Therefore, the step designating data "000" is transferred to the shift register 17 via the transfer gates 18-0 to 18-2. Subsequently, it is circulated in the circulating circuit consisting of the shift register 17, transfer gates 19-0 to 19-2, and the shift register 17. Then, the step designating data is applied to the input terminals A0 to A2 of the full-adder 16 every time the data is produced from the shift register 17 at the timing of the first channel.

When the data at the output terminals S0 to S3 of the half-adder 11 is "0000", the upper three-bit data "000" is inverted by the inverters 15-0 to 15-2 and input as "111" to the input terminals B0 to B2 of the full-adder 16. Accordingly, the result data of the full-adder 16 is "111" and no carry "0" is produced. This output of logical "0" enables the transfer gates 22-0 to 22-3 and disables the transfer gates 21-0 to 21-3. Under this condition, the only 8-step waveform data of the 8-step waveform data and the 16-step concurrently read out from the waveform memory 5 is selected. Since the waveform memory 5 is addressed by the address data "0000", the first step amplitude data of the 8-step waveform data as shown in FIG. 3A is read out and serves as the waveform data.

When the output terminals S0 to S3 of the half-adder 11 are changed to "0001", the upper three bits are "000" and those are the same as the previous ones. Accordingly, no carry is produced from the full-adder 16 and the amplitude data of the first step of the 8-steps is read out.

When the output of the half-adder 11 is further incremented by 1 and becomes "0010", the upper three-bit data "001" is inverted by the inverters 15-0 to 15-2 to be "110", which is in turn applied to the input terminals B0 to B2 of the full-adder 16. The addition result data is "110" and the carry output is "0". With this data, the second step amplitude data of the 8-step waveform data is read out and serves as the waveform data.

When the output of the half-adder 11 is further incremented and, becomes "0011", the upper three-bit data is "001" and same as the previous ones. Under this condition, the second step amplitude data of the 8-step data shown in FIG. 3A is read out and used as the waveform data.

When the output of the half-adder 11 is incremented one by one, "0100", "0101", . . . , "1111", the upper three bits change "010", "010", "011", "011", "100", "100", "101", "101", "110", "110", "111" and "111". Those three bits are inverted, by the inverters 15-0 to 15-2, into "101", "101", "100", "100", "011", "011", "010", "010", "001", "001", "000" and "000". Those bits are applied to the input terminals B0 to B2 of the fulladder 16. Those result data each have no carry "0". Any of those address data selects the 8-step waveform data from the data read out from the waveform memory 5 and is used as waveform data. In this case, the third to eigth step amplitude data in the 8-step waveform are sequentially used as the waveform data.

Figure 4A:
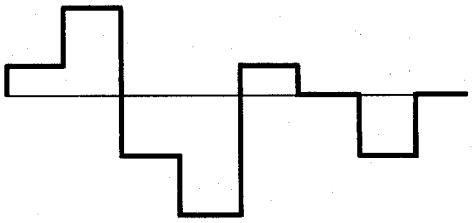
FIGS. 4A to 4H are waveforms generated according to input musical tone signals with different pitches.

FIG. 4A illustrates the waveform data when the step designating data "000" is produced. When comparing this waveform with that of FIG. 3A, both are exactly the same as the 8-step waveform shown in FIG. 3A.

If the pitch of the operated key corresponds to any one of the notes C4 to F4, the step designating data at the time of its key on is "001". The data applied to the input terminals A0 to A2 of the full-adder 16 at the first channel timing is "001". When the output data of the half-adder 11 is "0000" and "0001", the inverted upper three bits are "111". The result data are associated with a carry "1". Under this condition, the transfer gates 22-0 to 22-3 are disabled and the transfer gates 21-0 to 21-3 are enabled. As for both the outputs, only the amplitude data of the 16-step waveform data is read out. Also in this case, the first and second halves of the first step in the waveform in FIG. 3B are different from each other, and both the data are used as the amplitude data.

When the output of the half-adder 11 is incremented one by one, "0010", "0011", . . . , "1111", the inverted data of the upper three bits are "110", "110", . . . , "000", and the result data of the full-adder 16 on the step designating data "001" has no carry, i.e. "0". During this period of time, the 8-step waveform data is read out and is used as the amplitude data.

Figure 4B:
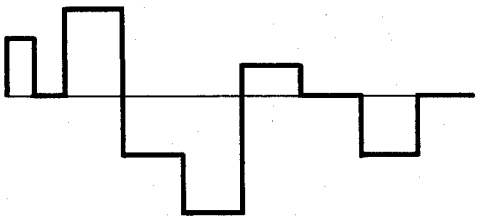

FIG. 4B shows the amplitude data for the abovementioned step designating data of "001". Also in this case, only the first step has the 16-step waveform data and the second to eigth steps have the 8-step waveform data.

Figure 4C:
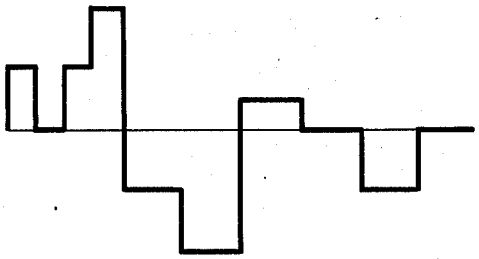
Figure 4D:
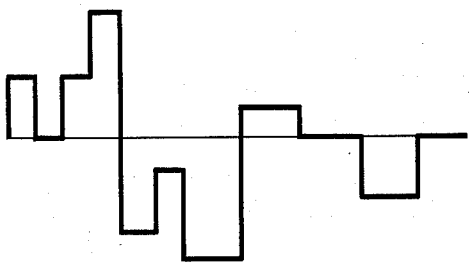
Figure 4E:
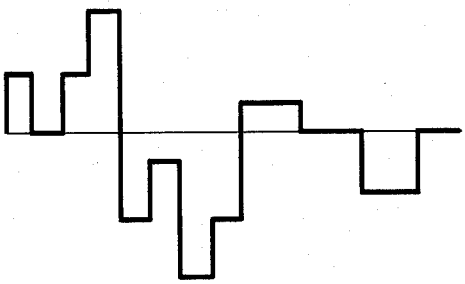
Figure 4F:
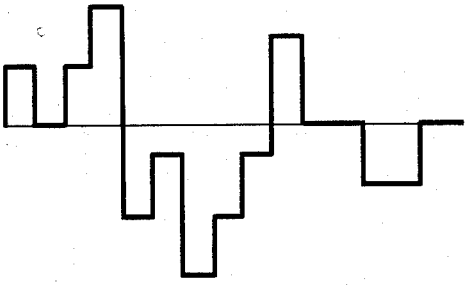
Figure 4G:
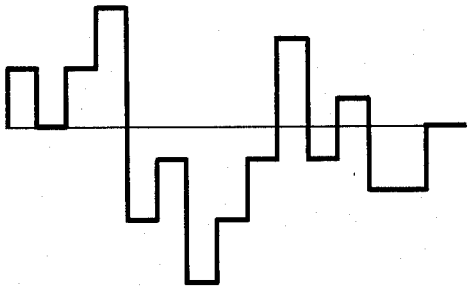
Figure 4H:
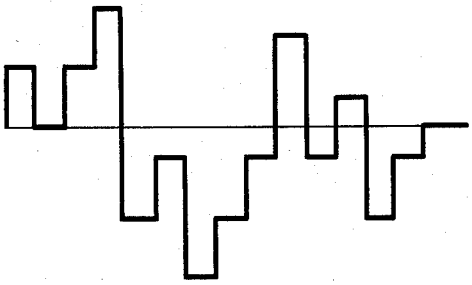

When the pitch of the operated key is any one of the notes F3# to B3, the step designating data output is "010". When the output of the half-adder 11, the address data, is "0000", "0001", "0010" or "0011", the inverted data of the upper three bits of the address data causes the full-adder 16 to produce the carry "1" data. Then, the 16-step waveform data is selected and used as the waveform data. In this case, the waveform data is as shown in FIG. 4C; the first and second steps have the 16-step waveform data in which two amplitude, data are contained for each step, and the third to eigth steps have the 8-step waveform data in which a single amplitude data is contained for two steps.

FIGS. 4D to 4H are waveform data obtained when the pitch of the operated key obtained under the abovementioned operation principle, corresponds to any one of the notes C3 to F3, F2# to B2, C2 to F2, F1# to B1, and C1 to F1. As seen from the figure, the amplitude data in the 1st to 3rd steps, the 1st to 4th steps, the 1st to 5th steps, the 1st–6th steps, and the 1st–7th steps are of the 16-step waveform type and the remaining ones are of the 8-step waveform type.

As described above, in the first embodiment, as the pitch of the musical tone is lower, the 16-step waveform, i.e. high harmonic component, is more contained in the waveform data. The rate in which the 16-step waveform is contained is stepwisely increased when the pitch of the tone is shifted from high to low. Thus, the timbre of the generated musical tone smoothly and naturally changes according to the pitch of the note.

In the above operation, the operated key is single. When two to four keys are simultaneously operated, the microprocessor 2 assigns vacant channels to the operated keys. In each channel, a similar operation dependent on the pitch of the operated key is performed as mentioned above.

Figure 5:
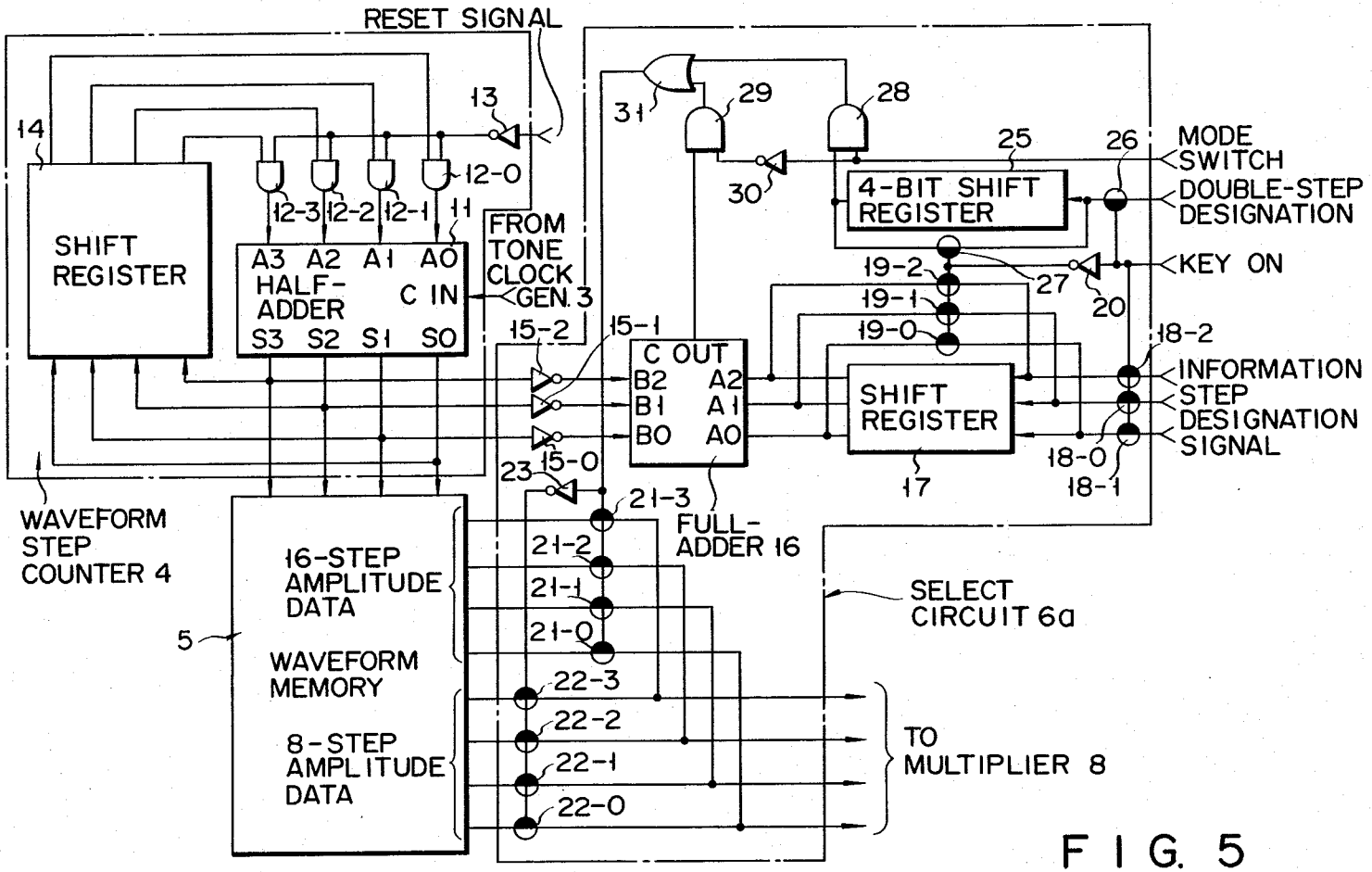
FIG. 5 is a block diagram illustrating major portions of another embodiment of a waveform data generating system according to the present invention.

A second embodiment of a waveform data generating system according to the present invention will be described referring to FIG. 5. The second embodiment has additionally a piano-like function to generate a musical tone of which timbre is greatly changed in a range of pitch below a predetermined tone pitch. Further, a select switch is provided for selecting this function or the function of the first embodiment by a mode select signal. A circuit arrangement of major portions of the second embodiment is illustrated in FIG. 5. As shown, the select circuit 6a is additionally provided with a 4-bit shift register 25, transfer gates 26 and 27, AND gates 28 and 29, an inverter 30 and an OR gate 31. The remaining circuit arrangement except these additional components is exactly the same as that of FIG. 2. In FIG. 5, like reference numerals are used for denoting like or equivalent portions in FIG. 2.

A double step designating signal is input to a shift register 25 via the transfer gate 26. The double step designating signal output from the shift register 25 is fed back to the shift register 25 via the transfer gate 27, and then the signal is circulated in this looped circuit. When the specific timbre of a piano, for example, is designated by a timbre designating switch, the microprocessor 2 judges a pitch of the operated key to provide the double step designating signal. This signal takes a logical level "1" for the operated keys in a range of notes below a predetermined pitch. The same signal takes a logical level "0" for the operated keys in a range of notes above the predetermined pitch. The key on pulse KEY ON is applied, directly or via the inverter 20, to the gates of the transfer gates 26 and 27. The transfer gates are opened or closed under control of the key on pulse.

The double step designating signal output from the shift register 25 is also applied to the AND gate 28. A carry from the full-adder 16 is supplied to the AND gate 29. A mode select signal from the microprocessor 2 is applied, directly or via the inverter 30, to the other inputs of the AND gates 28 and 29 for their gate controlling purposes. The output signals of the AND gates 28 and 29 are directly supplied to the gates of the tranfer gates 21-0 to 21-3, and further to the gates of the transfer gates 22-0 to 22-3 by way of the inverter 23. The mode select signal is logical level "0" for a mode for executing the function of the first embodiment, and is logical level "1" for a mode for executing a function to greatly change waveforms or timbres of musical tones at a designated note.

The operation of the second embodiment thus arranged will be described here. For playing music in a mode in which a timbre of a tone below a predetermined pitch greatly changes as in the case of a piano, for example, the timbre of the piano is designated by the timbre designating switch. Upon operation of the switch, the microprocessor 2 produces a mode select signal of logical level "1", thereby to enable the AND gate 28 and to disable the AND gate 29.

Upon starting of the musical performance, the microprocessor 2 assigns a channel to the operated key, and judges the pitch thereof to produce a double step designating signal of logical level "1" or "0" depending on a range of pitches set for the timbre of a piano, and applies the signal to the shift register 25 at the timing of the channel assigned to the operated key. When the note C2 is set for the reference pitch, the microprocessor 2 produces a double step designating signal of logical level "1" for low-pitch notes C1 to C2 of the keys, and a double step designating signal of logical level "0" for high-pitch notes C2# to B4 of the keys. In this case, the key-on pulse KEY ON of logical level "1" is produced at the timing of the channel assigned to the operated key to temporarily enable the transfer gate 26 and temporarily disable the transfer gate 27. As a result, the double step designating signal is input to the shift register 25. The double step designating signal, after output from the 4th stage of the shift register 25, is fed back to the input of the shift register 25 through the transfer gate 27 being enabled at the timing of the assigned channel, and is circulated in the feedback loop.

In the ON state of the operated key, the double step designating signal output from the shift register 25 is also applied to the AND gate 28. At this time, the AND gate 28 is being enabled. Accordingly, if the double step specifying signal is logical level "1", the AND gate 28 produces a signal of logical level "1" which enables the transfer gates 21-0 to 21-3 through the OR gate 31. Then, of the 8-step waveform data and the 16-step waveform data read out in parallel from the waveform memory 5 by the address data from the half-adder 11, the 16-step waveform data is selected and output as the waveform data. The musical tones in a lower range than the reference pitch (note C2) are generated by the 16-step waveform data.

When the double step designating signal input to the shift register 25 is logical level "0", the AND gate 28 produces a logical level "0" signal, thereby enabling the transfer gates 22-0 to 22-3 and selecting the 8-step waveform data as the waveform data. Thus, in a higher range than the reference pitch (note C2), the timbre of the musical tone is based on the 8-step waveform data.

Therefore, in playing music by operating the keyboard 1, the timbre of the musical tones is distinctively different in high and low ranges delineated by the reference pitch (note C2), thereby obtaining a natural tone with a timbre as generated by a musical instrument, for example, a piano.

Figure 2:
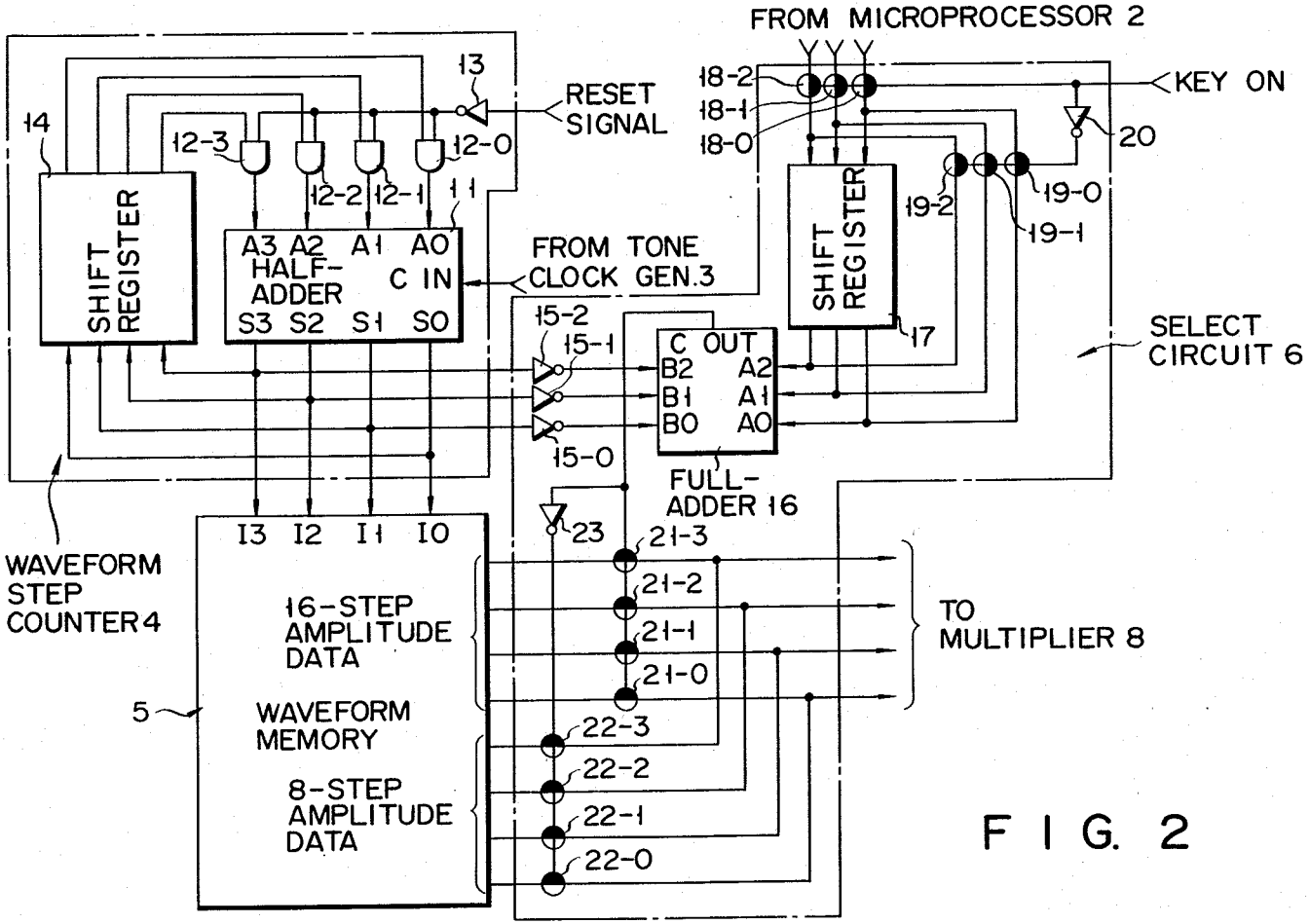
FIG. 2 is a block diagram illustrating configurations of major portions in the waveform data generating system of FIG. 1.

In the circuit of FIG. 5, in a mode to execute the function of the first embodiment of FIG. 2, the microprocessor 2, upon operation of the corresponding timbre select switch, produces a mode select signal of logical level "0". The mode select signal enables the AND gate 29, and disables the AND gate 28. Accordingly, during the musical performance, the carry of the full-adder 16 is output from the AND gate 29 and applied through the OR gate 31 to the transfer gates 21-0 to 21-3 or 22-0 to 22-3. Then, the transfer gates applied with the carry of "0" are enabled. In this way, the second embodiment performs the same operation as that of the first embodiment.

While both the above embodiments employ the 8-step waveform data and the 16-step waveform data, the number of steps is not limited to the above ones. In the above embodiments, two amplitude data are read out from one waveform read out step. Alternatively, three or more amplitude data may be read out from one read out step, and are selectively used for each address. The waveform of the musical tone stored in the waveform memory is not limited to the ones used in the above-mentioned embodiments. Further, the bit number of the step designating data may be properly selected according to the number of keys. Furthermore, in the above embodiments, a ratio of the 8-step waveform data and the 16-step waveform data is changed every 6 tones, but it may be changed every less than six tones, for example, three tones.

In the above embodiment, a plurality of waveform data are read out from the waveform memory and one of them is selected for each address. Alternatively, by appropriately changing the address signal applied to the waveform memory, one waveform data is read out for that address from the waveform memory. The amplitude data, which is used for the waveform data in the above embodiment, may be replaced by any other suitable data, such as differential waveform data. Further, the present invention may variously be changed or modified within the scope of the invention.

Figure 6:
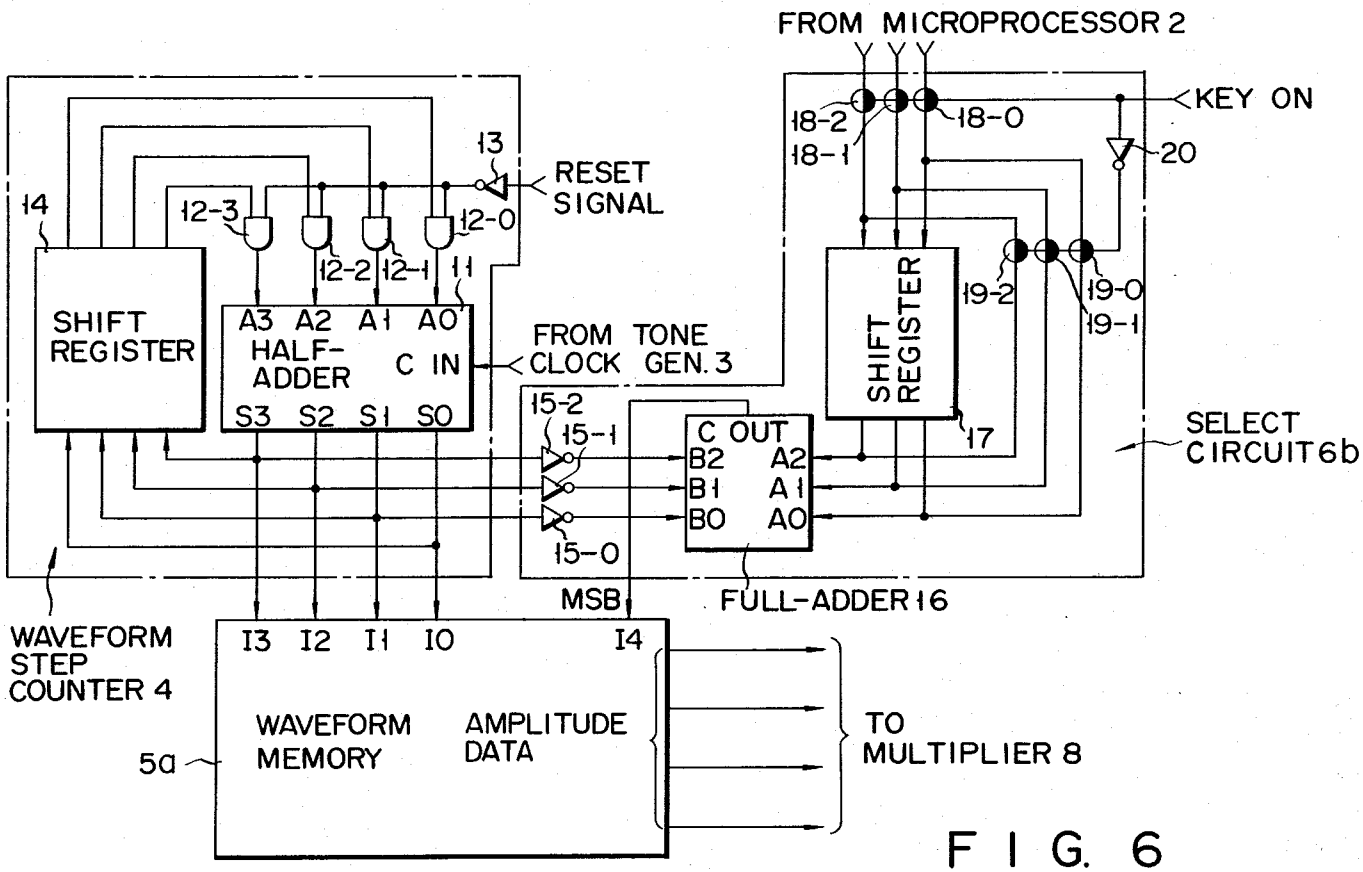
FIGS. 6 and 7 are block diagrams illustrating modifications of the embodiments shown in FIGS. 2 and 5, respectively.
Figure 7:
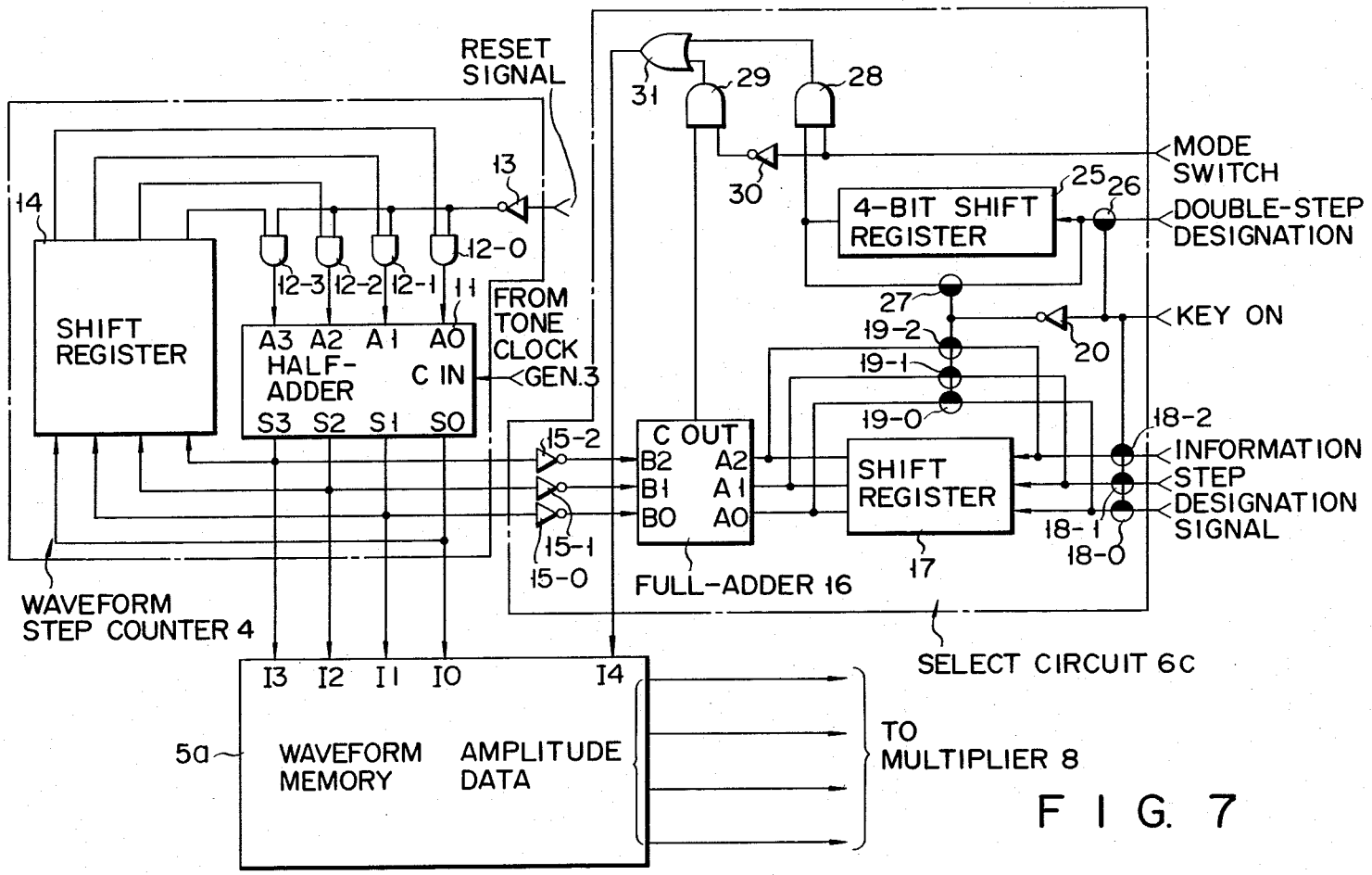

FIGS. 6 and 7 show modifications of the embodiments of FIGS. 2 and 5, respectively.

In FIG. 6, the carry output Cout from the full-adder 16 provided in a select circuit 6*b*, is directly supplied to an address input terminal I4 of a waveform memory 5*a*. The transfer gates 21-0 to 21-3, 22-0 to 22-3 are omitted from the select circuit 6*b* of FIG. 6. To the remaining address input terminals I0 to I3 are supplied outputs from the half-adder like in the embodiment of FIG. 2. The waveform memory 5*a* has two memory areas one of which may be addressed when the most significant bit of the address signal supplied at the terminal I4 is of logical level "1", and the other memory area may be addressed when the most significant bit to the terminal I4 is of logical level "0".

Thus, one waveform data is read out from the one memory area and the other waveform data is read out from the other memory area of the waveform memory 5*a*. The remaining circuit configuration and operation thereof is similar to those of FIG. 2 and further description may be omitted here.

Similar modification may be applied to the embodiment of FIG. 5 and is shown in FIG. 7. In this modification, the carry output Cout from the full-adder 16 provided in a select circuit 6*c*, which is not coupled with transfer gates 21-0 to 21-3, 22-0 to 22-3, is supplied to the input terminal I4 of the waveform memory 5*a* as the most significant bit of the address signal, through the AND gate 29 and the OR gate 31. The two memory areas each having 16-step waveform data of different type are selectively accessed according to the logical level of the most significant bit supplied to the waveform memory 5*a* like in the modification of FIG. 6.

As described above, a plurality of waveform data, of which the periods each are divided into a plurality of steps, are stored into a memory. The address signals representing the steps are used for making an access to the memory. One of the plurality of waveform data is selected for each address and used as the waveform data to be generated for the address. Such an arrangement can provide a musical tone with a natural timbre. The waveform data to be generated for the address is selected from the plurality of waveform data by using the data for designating the tone. Because of this feature, as the range of the musical tone is lower, the more overtone components are contained in the musical tone. The result is to provide a musical tone with a rich timbre. Further, the ratio of the one selected waveform data to the other waveform data is stepwisely changeable, thereby generating a natural feeling musical tone as generated by natural musical instruments. The musical tone of which the timbre is greatly changed at a predetermined pitch, as the sound of a piano, may also be generated naturally. Thus, the waveform data generating system according to the present invention can generate a musical tone with a variety of timbres.

What is claimed is:

1. A waveform data generating system, comprising:

memory means for storing at least two types of waveform data, wherein periods of said at least two types of waveform data are respectively divided into different numbers of steps;

inputting means for inputting musical tone data;

address signal generating means for generating an address signal to designate an address of the memory means at a rate as given according to the musical tone data entered by said inputting means; and means for selectively obtaining one of the at least two types of waveform data read out from said memory means in a predetermined address range of one period of a mixed waveform data to be formed and obtaining the other waveform data in the remaining address range thereof, so as to produce a mixed waveform data.

2. A waveform data generating system according to claim 1, in which said selectively obtaining means includes means for gradually increasing in said period of a mixed waveform data the proportion of the waveform data of which one period is divdied into a fewer number of steps, as the pitch of said input musical tone data becomes higher.

3. A waveform data generating system according to claim 1, in which said selectively obtaining means includes means for gradually increasing in said period of a mixed waveform data the proportion of the waveform data of which one period is divided into a greater number of steps, as the pitch of said input musical tone data becomes lower.

4. A waveform data generating system according to claim 1, in which said selectively obtaining means includes means for comparing whether or not the pitch of said input musical tone data is higher than a predetermined one, and means for selectively designating said at least two waveform data for each address according to the output of said comparing means.

5. A waveform data generating system, comprising:

memory means for storing first waveform data and second waveform data, one period of said first waveform data being divided into a predetermined number of steps, and one period of said second waveform data being divided into steps, the number of which is an even multiple of said predetermined number;

access means for sequentially supplying address signals corresponding to said second waveform data to said memory means to read out said second waveform data, and at the same time to read out said first waveform data at a period of an even multiple of said address signal; and gate means for allowing one of said first and said second waveform data simultaneously read out by said access means to be output as the amplitude data in a predetermined address range of one period of a mixed waveform data to be formed and the other waveform data to be output in the remaining address range thereof, so as to produce a mixed waveform data.

6. A waveform data generating system, comprising:

memory means for storing at least two types of waveform data, wherein periods of said at least two types of waveform are respectively divided into different numbers of steps which are assigned to different addresses;

inputting means for inputting musical tone data; and address signal generating means for generating an address signal to designate an address of the memory means at a rate as given according to the input musical tone data entered by said inputting means for selectively obtaining one of the at least two types of waveform data from the memory means in a predetermined address range of one period of a mixed waveform data to be formed and obtaining the other waveform data in the remaining address range thereof, so as to produce a mixed waveform data.

7. A waveform data generating system according to claim 6, in which address signal generating means includes means for gradually increasing in said period of a mixed waveform data the proportion of the waveform data of which one period is divided into a fewer number of steps, as the pitch of said input musical tone data becomes higher.

8. A waveform data generating system according to claim 6, in which said address signal generating means includes means for gradually increasing in said period of a mixed waveform data the proportion of the waveform data of which one period is divided into a greater number of steps, as the pitch of said input musical tone data becomes lower.

9. A waveform data generating system according to claim 6, in which said address signal generating means includes means for comparing whether or not the pitch of said input musical tone data is higher than a predetermined one, and means for selectively designating said at least two waveform data for each step according to the output of said comparing means.

10. A waveform data generating system, comprising:

memory means for storing first waveform data and second waveform data, one period of said first waveform data being divided into a predetermined number of steps, and one period of said second waveform data being divided into steps, the number of which is an even multiple of said predetermined number; and access means for selectively supplying address signals corresponding to said first and said second waveform data to said memory means to read out one of said first and said second waveform data in a predetermined address range of one period of a mixed waveform data to be formed and the other waveform data in the remaining address range thereof so as to produce a mixed waveform data, said first waveform data being read out at a period which is an even multiple of the period at which said second waveform data is read out.

11. A waveform data generating system according to claim 10, in which said access means includes means for gradually increasing a rate of the use of said first waveform data as the pitch of the input musical tone data becomes higher, and increasing a rate of the use of said second waveform data as the pitch of the input musical tone data becomes lower.

12. A waveform data generating system according to claim 10, in which said access means includes means for reading out said first waveform data when the pitch of the input musical tone data is higher than a predetermined one, and for reading out said second waveform data when the pitch is lower than the predetermined one.

13. A waveform data generating system, comprising:

means for inputting musical tone data;

memory means for storing first waveform data and second waveform data, one period of said first waveform data being divided into a predetermined number of steps, and one period of said second waveform data being divided into steps the number of which is an even multiple of said predetermined number;

access means for sequentially supplying address signals corresponding to said second waveform data to said memory means to read out said second waveform data, and at the same time to read out said first waveform data at a period of an even multiple of said address signal;

gate means for allowing one of said first and said second waveform data simultaneously read out by said access means to be output as the amplitude data for the designated address;

control means for executing according to the pitch of the input musical tone data such a control that one of said first and second waveform data is used in a predetermined address range and the other waveform data is used in the remaining range; and means for providing the output of said control means for the gate controlling of said gate means;

wherein said control means includes means for gradually increasing a rate of the use of said first waveform data as the pitch of the input musical tone data becomes higher, and increasing a rate of the use of said second waveform data as the pitch of the input musical tone becomes lower.

14. A waveform data generating system, comprising:

means for inputting musical tone data;

memory means for storing first waveform data and second waveform data, one period of said first waveform data being divided into a predetermined number of steps, and one period of said second waveform data being divided into steps the number of which is an even multiple of said predetermined number;

access means for sequentially supplying address signals corresponding to said second waveform data to said memory means to read out said second waveform data, and at the same time to read out said first waveform data at a period of an even multiple of said address signal;

gate means for allowing one of said first and said second waveform data simultaneously read out by said access means to be output as the amplitude data for the designated address;

control means for executing according to the pitch of the input musical tone data such a control that one of said first and second waveform data is used in a predetermined address range and the other waveform data is used in the remaining range, and means for providing the output of said control means for the gate controlling of said gate means;

wherein said control means includes means for reading out said first waveform data when the pitch of the input musical tone data is higher than a predetermined one, and reads out said second waveform data when the pitch is lower than the predetermined one.

15. A waveform data generating system, comprising:

means for inputting musical tone data;

memory means for storing at least first waveform data and second waveform data, one period of said first waveform data being divided into a predetermined number of steps, and one period of said second waveform data being divided into steps the number of which is different from that of the first waveform data;

means for generating an address signal to designate an address in the memory means at a rate as given according to the pitch of the input musical tone data for selectively obtaining amplitude data at given steps of the first and second waveform data from the memory means;

control means for executing according to the pitch of the input musical tone data such a control signal that one of said first and second waveform data is first read out to be used in a predetermined address range of one period of a mixed waveform data and the other waveform data is read out to be used in the remaining address range;

wherein said control means includes means for gradually increasing in said period of a mixed waveform data a rate of the use of said first waveform data as the pitch of the input musical tone data becomes higher, and increasing a rate of the use of said second waveform data as the pitch of the input musical tone becomes lower.

16. A waveform data generating system, comprising:

means for inputting musical tone data;

memory means for storing at least first waveform data and second waveform data, one period of said first waveform data being divided into a predetermined number of steps, and one period of said second waveform data being divided into steps the number of which is different from that of the first waveform data;

means for generating an address signal to designate an address in the memory means at a rate as given according to the pitch of the input musical tone data for selectively obtaining amplitude data at a given steps of the first and second waveform data from the memory means;

control means for executing according to the pitch of the input musical tone data such a control signal that one of said first and second waveform data is first read out to be used in a predetermined address range of one period of a mixed waveform data and the other waveform data is read out to be used in the remaining address range;

wherein said control means includes means for comparing whether or not the pitch of said input musical tone data is higher than a predetermined one, and means for selectively reading out said at least two waveform data for each step according to the output of said comparing means.

* * * * *